United States Patent [19]

Mock

[11] Patent Number: 4,853,910

[45] Date of Patent: Aug. 1, 1989

[54] TIMEPIECE HAVING CASE FORMED OF ROCK-LIKE MATERIAL

[75] Inventor: Elmar Mock, both of Bienne, Switzerland

[73] Assignee: ETA SA Fabriques d'Ebauches, Granges, Switzerland

[21] Appl. No.: 81,970

[22] Filed: Aug. 5, 1987

Related U.S. Application Data

[62] Division of Ser. No. 847,369, Apr. 2, 1986, Pat. No. 4,692,033.

[30] Foreign Application Priority Data

Oct. 7, 1985 [CH] Switzerland ..... 4329/85

[51] Int. Cl.[4] ..... G04B 37/00; G04B 29/00

[52] U.S. Cl. ..... 368/300; 368/309; 368/281; 368/282; 368/280; 368/299

[58] Field of Search ..... 368/280–282, 368/291, 292, 309, 300, 276, 294, 299, 295, 296

[56] References Cited

U.S. PATENT DOCUMENTS

| | | | |
|---|---|---|---|
| 3,719,038 | 3/1973 | Klingenberg | 368/280 |
| 3,733,807 | 5/1973 | Nozawa | 368/291 |
| 4,620,798 | 11/1986 | Scarinzi | 368/294 |
| 4,692,033 | 9/1987 | Mock et al. | 368/280 |

FOREIGN PATENT DOCUMENTS

| | | | |
|---|---|---|---|
| 1398410 | 6/1963 | France . | |
| 2254814 | 12/1973 | France | 368/300 |
| 250700 | 1/1948 | Switzerland | 368/300 |
| 562465 | 5/1975 | Switzerland . | |
| 632375 | 10/1982 | Switzerland | 368/309 |

OTHER PUBLICATIONS

Transportation Design and Technology, Inc. V. General Motors Corp. et al. 4/14/1980 212USPQ574.

*Primary Examiner*—Bernard Roskoski
*Attorney, Agent, or Firm*—Sughrue, Mion, Zinn, Macpeak and Seas

[57] ABSTRACT

A timepiece includes an outer caseband 3 formed entirely in one piece of a hard material which likewise includes a hub member 4 providing the timepiece dial, and a metallic inner caseband 16. An annular step 10 for positioning and glue fastening a crystal 9 surrounds the hub member. This arrangement gives the hard material the rigidity necessary to resist forces acting thereon during manufacture and subsequently when the watch is worn.

13 Claims, 1 Drawing Sheet

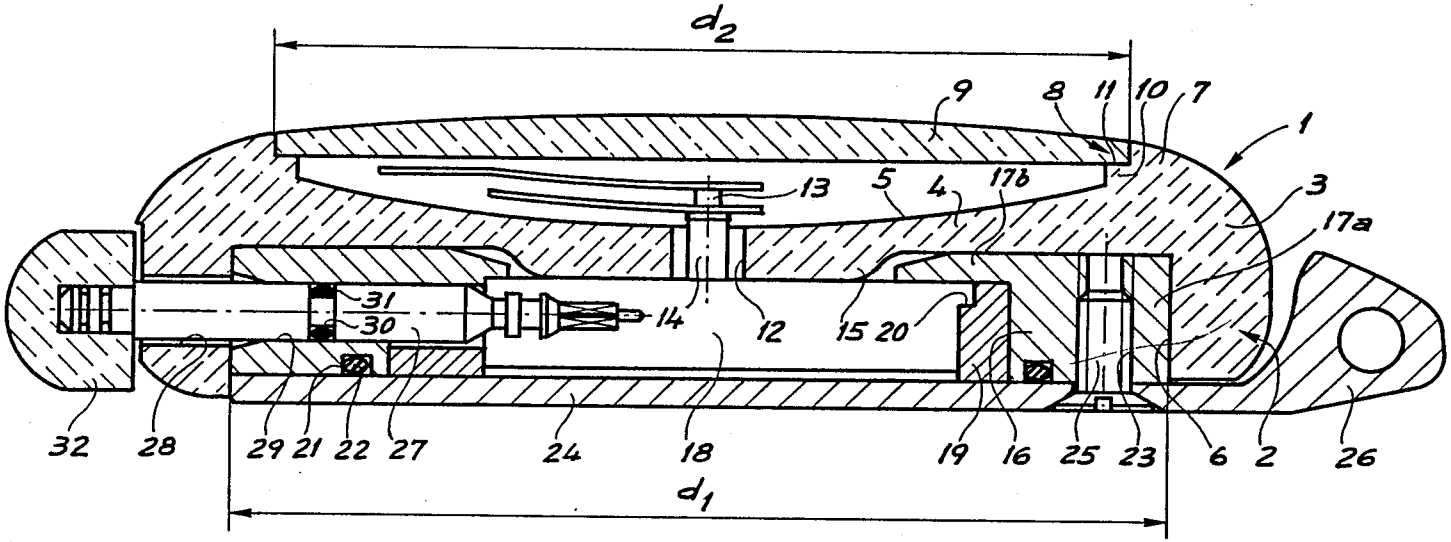
1
2
3
4
5
6
7
8
9
10
11
12
13
14
15
16
17a
17b
18
19
20
21
22
23
24
25
26
27
28
29
30
31
32
$d_1$
$d_2$

TIMEPIECE HAVING CASE FORMED OF ROCK-LIKE MATERIAL

This is a division of application Ser. No. 847,369, filed Apr. 2, 1986 now U.S. Pat. No. 4,692,033.

BACKGROUND OF THE INVENTION

This invention concerns timepieces including a case formed at least partially from a hard natural or artificial mineral material such as granite or semi-precious stones, or, such as carbides or nitrides of certain metals as for instance tungsten or titanium.

In U.S. Pat. No. 3,242,664 there is described a timepiece the case of which includes an inner metal caseband to which is fitted a crystal and a back cover surmounted by a protective cap. The latter is formed from a hard material by sintering a powder based on a metallic carbide. The inner caseband is glued to the cap basically in order to compensate for variations in the cap tolerances, it being well known that the dimensions thereof cannot be obtained precisely in view of the considerable shrinkage which occurs during the sintering operation.

Should it be wished to replace the cap of sintered material in this particular case by a cap of hard stone there must be machined in the latter a central opening to enable assembly of the crystal onto the inner metallic caseband and evidently likewise to enable observation of the dial which is also fastened onto this inner caseband. This arrangement renders such substitutions extremely difficult since machining of hard stone is obtained by grinding, this being a machining operation during which only relatively small amounts of material may be removed in a given time period. To this must be added that the central opening weakens substantially the cap from whence there arises major risks of breakage during the machining and assembly operations of the timepiece. Thus should one undertake such substitution one may also be confronted with a high rate of rejects having as consequence a relatively high manufacturing price.

On the other hand in view of the presence of the metallic ring forming the inner caseband one finally obtains a timepiece of high rigidity with effective protection of the case against wear by virtue of the cap.

In sum from this analysis of U.S. Pat. No. 3,242,664 it may be determined that the case described therein is mediocre as to its rigidity during the course of manufacture while such rigidity is satisfactory to the timepiece user.

Finally it may be noted that the weakness of the cap will be a negative factor during manufacture whether it be formed of sintered material or machined stone.

U.S. Pat. No. 4,075,828 provides a teaching which contributes to perfecting the assembly described in U.S. Pat. No. 3,242,664 in the sense that it recommends employment of a piece of machined semi-precious material including a caseband lacking a central opening, which in this case remains blocked by a curved surface formed entirely in one piece with the caseband and serving as a dial for the timepiece. This part which is of relatively simple form requires however machining of the movement housing, of the space between the attachment lugs and above all of several through holes intended to accommodate the fastening feet. Effectively it is by such feet that a bezel intended for fastening the crystal and a back cover is applied to the caseband, the feet cooperating with nuts screwed thereon and embedded in the thickness of the back cover. Anti-moisture packings are squeezed against the two faces of the caseband respectively by the bezel and the back cover.

Although this arrangement provides certain advantages in respect of manufacture of the part forming as one single piece the caseband and the dial, it nevertheless remains necessary to carry out a delicate machining operation on the stone, namely piercing the passage holes for the fastening feet. The presence of these holes can moreover also cause cracks leading to breakage in the stone either during machining or when worn, whenever the part undergoes shocks. Such difficulty evidently may be overcome but only at the price of increasing the thickness of the stone part which in turn increases the overall thickness of the timepiece.

Furthermore in the arrangement of this patent the movement is held in its housing by a lateral groove formed in the wall of the housing. This groove likewise necessitates a delicate machining operation in the stone. Such fastening method also implies that the movement be elastically supported against the bottom of the housing (i.e. on the central face of the curved surface opposite the dial). Consequently when the timepiece undergoes shocks while being worn the inertia of the movement acting against this curved surface brings about a risk of starting ruptures at the junction point thereof with the caseband.

Finally it is to be noted that this assembly comprises numerous components and employs packings applied to the faces of the stone whereby it is not possible to guarantee perfect anti-moisture sealing in view of the nature of the stone material.

SUMMARY OF THE INVENTION

The invention thus has as its object to provide a timepiece including a case formed at least partially from a hard natural or artificial mineral material, a movement housed within said case, a crystal and a back cover, said case comprising an inner caseband receiving the movement and being fixed to the back cover, an outer caseband surrounding the inner caseband and formed from said hard material, a hub member providing the timepiece dial and formed as one piece with the outer caseband and, means for positioning and fastening said crystal girdling said hub member and arranged in the outer caseband, said inner and outer casebands being assembled to one another by gluing.

Thanks to these characteristics there is obtained a timepiece in which the portion of the case formed in one single piece from hard mineral material has a simple form with a minimum of discontinuities and lacks through holes with the exception of those to permit passage of the axles for the hands and the stem in a manner such that the resistance of the timepiece is improved as much during manufacture as during wear.

A further purpose of the invention is that of providing a timepiece in which the sealing problem is solved in a simple and effective manner.

To this end the crystal, according to the invention, is fastened to the outer caseband by gluing.

Thereby, sealing of the interfaces including the surfaces of mineral material is obtained by means of glue, while sealing of the metal to metal interfaces is obtained by means of packings. There results therefrom that the mineral material does not undergo any permanent stress in assuring fastening of the different parts of the watch to the caseband.

A further purpose of the invention is to obtain a timepiece in which all parts of the case visible to the wearer with the exception of the bracelet attachment lugs are formed of the mineral material.

This purpose is attained by virtue of the fact that the outer edge of the inner caseband is entirely covered by the outer caseband.

The timepiece thus obtained exhibits a notable aesthetic effect with optimum protection of the parts susceptible to wear.

BRIEF DESCRIPTION OF THE DRAWING

The single figure shows a broken diametral cross-section of a timepiece according to the invention.

DESCRIPTION OF THE PREFERRED EMBODIMENT

In accordance with the example shown in the figure the timepiece includes a case 1 including a part 2 formed of hard natural or artificial material such as granite, a semi-precious stone, a metallic carbide, a mono-crystaline metallic oxyde or the like. This part which is formed in a single piece includes a ring forming an outer caseband 3 or a "wheel" portion of the case and a hub portion 4 which blocks and extends across the ring at approximately ¾ of its height, such hub portion forming the timepiece dial 5 on its upper face.

It is thus that part 2 bounds a circular central housing 6 which is coaxial with the outer caseband 3. The latter exhibits a periphery of semi-toroidal form. However it should be observed that the form of caseband 3 and placing of housing 6 are not to be considered as limiting and are only determined by the desired aesthetic of the timepiece, the housing 6 being capable of off-center location relative to the general form of the stone caseband 3 which itself may take on greatly varied external forms likewise determined by aesthetic considerations.

The face of the hub portion 4 which forms dial 5 is concave while it is bordered by a raised peripheral portion 7 of the outer caseband 3. This portion 7 determines by its form positioning and fastening means 8 for a crystal 9. In the arrangement shown such means comprise an annular step 10 limiting a shoulder 11 on which may be applied crystal 9 by means of a glue joint. The crystal 9 is thus embedded in the thickness of the outer caseband.

The hub portion 4 is pierced at its center by a hole 12 to enable passage of axles 13 and 14 for the hands. Furthermore its central zone includes a stiffening portion 15 to give the hub portion rigidity at this place. This stiffening portion is obtained by continuing machining of housing 6 at the end of such operation only at the periphery of the bottom thereof.

A metallic inner caseband 16 is placed in housing 6. This caseband includes an annular ring 17*a* from which extends flange 17*b* towards the interior and which is glued to the outer caseband 2 by glue joints interposed between the respective peripheral exterior and interior walls of the casebands and likewise (although not indispensable) between the face of the upper extremity of the inner caseband 16 and the portion of the corresponding lower face of the hub portion 4.

The inner caseband 16 is initially intended to receive movement 18 by an interposed member in the form of a casing ring 19. In the example as shown movement 18 is supposed to be of the barrel type, the casing ring thus not exhibiting a constant radial cross-section over its entire periphery as may be seen to the left and the right of the figure. The casing ring includes a shoulder 20 cooperating with a collar provided in a standard manner on the movement periphery.

An annular groove 21 is provided in the lower face of the inner caseband to accommodate an anti-moisture packing 22. Furthermore several threaded holes 23 are provided in this caseband in order to enable its assembly with a back cover 24 by means of screws 25. The back cover 24 is formed by a circular plate of which the form may be adapted to the aesthetic of the whole and which is placed almost entirely in the opening of housing 6. Such plate bears attachment lugs 26 at noon and at six o'clock intended to fasten a bracelet (not shown on the drawing).

It may thus be determined that for sealing thereof the timepiece requires only one packing at the bottom acting effectively through contact with metal, the packing moreover being surrounded in all its parts by the rectangular section bounded by the back cover and groove 21.

One may likewise note that the inner caseband 16 exhibits an outer diameter $d_1$ greater than the diameter $d_2$ of the crystal. This arrangement is intentional in order to give the inner caseband 16 the function of supporting the fragile zone located at the junction between the hub portion 4 and the outer caseband 3. In case of shock during wear the risks of breakage at this place are thus substantially reduced.

There will now be described in detail how the passage for the time setting stem 27 is obtained. The latter passes through a radial hole 28 pierced in the outer caseband 3 as well as a radial hole 29 formed in the inner caseband 16, this latter being adjusted to the diameter of stem 27 to enable rotation thereof while assuring its guidance. The stem 27 itself is provided with a groove 30 which is located approximately midway along the radial hole 29 and which is intended to accommodate a seal 31. It constitutes thus once again a seal acting against metallic surfaces which here assures moisture sealing in respect of the exterior. A crown 32 formed from the same material as part 2 may cap the outer end of stem 27 being retained on the latter by gluing for example.

It will be noted that the hole in the inner caseband 16 for passage of stem 27 is almost tangent to the radial plane containing the upper face of movement 18. This is due to the fact that stem 27 must have a relatively large diameter in order to permit forming groove 30 for seal 31. If the lower face of the hub portion 4 were flat there would result therefrom that the thickness of material between hole 29 and the upper face of inner caseband 16 would be very small which could lead to hole 27 becoming of oval form thus no longer guarantee good contact with seal 31 and a loss of sealing capacity.

Thanks to the fact that housing 6 includes in the periphery of its bottom a groove which surrounds stiffening portion 15 and which enables use of a thicker inner caseband 16 one may guarantee sealing of the watch without increasing the thickness thereof.

his special solution has been made possible in view of the fact that the face of the hub portion 4 which forms the dial 5 is concave and that the housing is initially machined over its entire surface and thereafter only over the surface of the groove. It thus results that the cross-section of the hub portion at the level of step 10 remains sufficient to withstand the pressure applied thereto during the machining operation.

Machining of part 2 in hard material is preferably obtained through a process of abrasion with a diamond grinder well known to specialists. Within the framework of the invention such machining does not demand any particular precision in view of the presence of the inner caseband which here is the timepiece element assuring all functions requiring precision among which may be cited positioning of the movement, tightening of the packings 22 and 31 and positioning of screws 23 relative to the back cover.

What is claimed is:

1. A timepiece comprising a case (1) and a movement (18) received in said case.

(a) said case comprising a first caseband (16), a second caseband (3), a back cover (24) and a crystal (9), (b) said first caseband being formed of comparatively easily machinable metal and receiving said movement, said first caseband comprising means (23) for fixing the back cover thereto, (c) said second caseband being made of a comparatively brittle and difficult to machine hard natural or artificial mineral material, said second caseband being assembled to said first caseband by gluing and comprising, integrally formed with said second caseband;

(i) a hub portion (4) providing a timepiece dial, and (ii) means (8) for positioning and fastening said crystal, said crystal positioning and fastening means extending continuously around the periphery of said hub portion (4) and retaining said crystal (9) by gluing.

2. A timepiece according to claim 1, wherein said case further comprises sealing means (22) interposed between said back cover and said first caseband.

3. A timepiece according to claim 2, wherein said first caseband is an inner caseband, and said second caseband is an outer caseband surrounding said inner caseband.

4. A timepiece according to claim 1 in which the crystal positioning and fastening means comprises an annular step (10) arranged in the outer caseband around said hub portion on the dial side thereof, said step defining a radial shoulder (11) onto which the crystal is fastened.

5. A timepiece according to claim 3 in which the hub portion is concave on the dial side thereof.

6. A timepiece according to claim 3 comprising a housing (6) bounded by the outer caseband and the hub portion for receiving the inner caseband and the movement, said housing including an annular axial recess at an outer periphery thereof to accommodate the inner caseband and a thickened central stiffening portion (15) defined by the hub portion, said annular recess being axially supported by the inner caseband.

7. A timepiece according to claim 3, wherein the inner caseband exhibits an outer diameter ($d_1$) greater than the outer diameter ($d_2$) of the crystal.

8. A timepiece according to claim 6, wherein the inner caseband exhibits an outer diameter greater than the outer diameter of the crystal.

9. A timepiece according to claim 3, wherein the inner caseband includes an annular ring (**17*a*) and a radial flange (17*b***) extending inwardly from said ring and underlying an inner face of the hub portion.

10. A timepiece according to claim 6, wherein the inner caseband includes an annular ring (**17*a*) and a radial flange (17*b***) extending inwardly from said ring and underlying an inner face of the hub portion, and lying within said recess.

11. A timepiece according to claim 3, including a time setting stem (27), the outer and inner casebands being respectively pierced with axially aligned radial holes (28, 29), said stem including a groove (30) midway along a portion thereof intended to traverse the hole in the inner caseband, said groove accommodating a moisture seal (31) to assure moisture resistance of the timepiece by engagement with the inner caseband.

12. A timepiece according to claim 1, including a bracelet and in which the back cover includes means (26) for fastening the bracelet to the case.

13. A timepiece according to claim 3, in which an outer peripheral edge of the inner caseband is entirely covered by the outer caseband.

* * * * *